United States Patent [19]

Sakai et al.

[11] 4,208,210

[45] Jun. 17, 1980

[54] PROCESS FOR FORMING AN OPTICAL SOUNDTRACK

[75] Inventors: Tadao Sakai, Minami-ashigara; Masayoshi Kawai, Fujimiya, both of Japan

[73] Assignee: Fuji Photo Film Co., Ltd., Minami-ashigara, Japan

[21] Appl. No.: 780,885

[22] Filed: Mar. 24, 1977

Related U.S. Application Data

[63] Continuation-in-part of Ser. No. 642,629, Dec. 19, 1975, abandoned.

[30] Foreign Application Priority Data

Dec. 19, 1974 [JP] Japan ..... 49/146088

[51] Int. Cl.[2] ..... G03C 7/24

[52] U.S. Cl. ..... 430/140; 430/376; 430/385; 430/387; 430/389; 430/503; 430/512; 430/553

[58] Field of Search ..... 96/39, 67, 100 R, 4, 96/55

[56] References Cited

U.S. PATENT DOCUMENTS

| | | | |
|---|---|---|---|
| 2,266,452 | 12/1941 | Vittum et al. | 96/100 |
| 2,373,821 | 4/1945 | Fröhlich et al. | 96/100 |
| 3,253,921 | 5/1966 | Sawdey | 96/84 UV |
| 3,705,799 | 12/1972 | Bello et al. | 96/39 |
| 3,705,800 | 12/1972 | Lane | 96/4 |
| 3,705,801 | 12/1972 | Holtz | 96/4 |
| 3,705,802 | 12/1972 | Baptista | 96/4 |
| 3,705,803 | 12/1972 | Bevis et al. | 96/4 |
| 3,715,208 | 2/1973 | Lestina et al. | 96/4 |
| 3,737,312 | 6/1973 | Baptista et al. | 96/39 |
| 3,749,572 | 7/1973 | Willis et al. | 96/4 |
| 3,926,633 | 12/1975 | Custer | 96/39 |
| 3,936,305 | 2/1976 | Hiraishi et al. | 96/84 UV |
| 3,940,271 | 2/1976 | Kawai et al. | 96/4 |
| 3,964,905 | 6/1976 | Hirose et al. | 96/39 |
| 3,996,055 | 12/1976 | Minagawa et al. | 96/100 |
| 4,075,018 | 2/1978 | Custer | 96/39 |

FOREIGN PATENT DOCUMENTS

| | | | |
|---|---|---|---|
| 4859838 | 8/1973 | Japan | 96/100 |
| 519208 | 3/1940 | United Kingdom | 96/100 |
| 1424454 | 1/1973 | United Kingdom | 96/39 |

OTHER PUBLICATIONS

The Focal Encyclopedia of Photography, ©1969, McGraw-Hill Book Co., N.Y. pp. 778, 779, 486, 487.

American College Dictionary, ©1970, Random House N.Y. p. 238.

Forrest, SMPTE Journal, A Comparison of Soundtrack Processing Methods for Color Release Positive Film, pp. 380–382, vol. 64, No. 7, Jul. 1955.

*Primary Examiner*—Travis Brown

*Attorney, Agent, or Firm*—Sughrue, Rothwell, Mion, Zinn and Macpeak

[57] ABSTRACT

A process for forming an optical sound track comprising applying ultraviolet light exposure to an optical sound track area of a multi-layer color photographic light-sensitive material comprising a support, color image-forming silver halide emulsion layers consisting of at least one blue-sensitive silver halide emulsion layer containing a yellow dye-forming coupler, at least one red-sensitive silver halide emulsion layer containing a cyan dye-forming coupler, and at least one green-sensitive silver halide emulsion layer containing a magenta dye-forming coupler, and at least one ultraviolet light-sensitive silver halide emulsion layer (sound track forming layer) containing a non-diffusible silver bleach inhibitor and an infrared dye-forming coupler which forms a dye having an absorption maximum at wavelengths longer than 725 nm, wherein at least one layer interposed between the ultraviolet light-sensitive silver halide emulsion layer and the support contains a non-diffusible ultraviolet absorbant.

17 Claims, 12 Drawing Figures

PROCESS FOR FORMING AN OPTICAL SOUNDTRACK

This application is a continuation-in-part of Ser. No. 642,629, filed Dec. 19, 1975, now abandoned.

BACKGROUND OF THE INVENTION

1. Field of the Invention

The present invention relates to a process for recording sound images on color photographic light-sensitive materials. More particularly, the present invention is concerned with the formation of one or more optical sound tracks on multi-layer color photographic light-sensitive materials.

2. Description of the Prior Art

In general, methods of recording sound images on color photographic light-sensitive materials used in movies and television are divided into optical recording processes and magnetic recording processes. The present invention is concerned with a method of forming sound tracks suitable for optical recording processes, typically at one edge of the material.

Sounds recorded by optical recording processes on color print films, color reversal films, color reversal print films, and the like used in the field of movies or television are reproduced through the stages of converting the sound signals recorded as a variation in densities or areas into light signals, converting the light signals into electric signals by a light-acceptor, and then converting the electric signals into sound signals. In this reproduction, photoelectric tubes having various spectral properties are used as the light-acceptor. Photoelectric tubes of the "S-1 type" are most widely used and they have a maximum spectral sensitivity at about 800 m$\mu$ in the infrared region (see, for example, Adrian Cornwell Clyne, Color Cinematography, page 593 (1951)).

On the other hand, in conventional subtractive color photographic light-sensitive materials, the main absorption of dyes produced by coupling of the oxidation products of developing agents such as paraphenylenediamines with color couplers is in the visible region, which does not correspond with the spectral properties of the above described photoelectric tubes. Therefore, the sound output due only to these colored dye images is extremely weak and practically unusable. Thus, in sound reproduction using color photographic light-sensitive materials, a treatment wherein silver or silver sulfide images are formed on the sound track is usually conducted during processing, and the densities of these silver or silver sulfide images in the infrared region are utilized for sound reproduction. In this case, the infrared density (transmission density) is generally from about 1.0 to about 1.6.

The formation of a sound track on color print films can be carried out by processing as described in, for example, *Journal of the Society of Motion Picture and Television Engineers,* Vol. 61, page 667–701 (1953).

In accordance with this method, color images in the picture image zone and sound images in the sound track area are simultaneously color developed in a color developing bath. In a first fixing bath, unexposed silver halide is removed and then the developed silver produced at development is re-halogenated in a bleaching bath. At the sound developing stage, silver halide only at the sound track area is converted into silver images by selectively coating a viscous sound developer onto the sound track area. In a second fixing bath silver halide in the picture image area is removed by fixing, whereafter dye image are stabilized in a stabilizing bath. The densities in the infrared region are predominantly used in sound reproduction.

As described above, the production of the sound track in color films requires a processing step wherein silver or silver sulfide images are produced. The reason why such a sound track comprising silver or silver sulfide is provided is, as described above, that the spectral properties of photoelectric tubes as are used in sound reproduction have their maximum sensitivity in the infrared region, whereas the colored dyes produced by color development are not dyes of a sufficient density in this wave-length region. A step wherein silver or silver sulfide images are formed in the sound track area is required in addition to a step wherein dye images are formed in the picture image area. A method of forming sound images without using any such special processing stage has been desired by the art.

Recently, as one means of solving the above problem, method has been proposed which comprises incorporating into the silver halide emulsion layers of a color photographic light-sensitive material compounds which markedly reduced the speed of silver bleaching at the bleaching step of color processing or which substantially prevent the silver bleach, or compounds that cause silver bleaching only at the beginning of the silver bleaching step to attain a definite degree of silver bleaching, but thereafter cause substantially no additional silver bleaching. Hereinafter, compounds capable of controlling or interrupting silver bleaching are called "silver bleach inhibitors".

In general, color photographic light-sensitive materials comprise a support and silver halide emulsion layers having different light-sensitive regions superposed on the support. An image-wise exposure followed by color development of such a photographic material provides dye images and silver images. Then, upon bleaching, the silver images are oxidized and then removed from the photographic materials by fixing. Thus, color photographs comprising only dye images are obtained.

The above described color photographic light-sensitive materials have at least one layer containing silver bleach inhibitors capable of forming silver images which cannot be removed by bleaching, and they can provide color photographs having silver images together with color images by conventional color processings. These silver images can advantageously be used as the sound track.

As color photographic light-sensitive materials having at least one layer containing the above described silver bleach inhibitors and capable of forming silver images which cannot be removed by silver bleaching (hereinafter, this layer is referred to as a "sound track forming layer"), there can be mentioned color photographic light-sensitive materials having picture image-forming silver halide emulsion layers and sound image-forming silver halide emulsion layers containing non-diffusible silver bleach inhibitors (for example, non-diffusible thiol compounds) incapable of forming a picture image upon picture image-wise exposure, as described in, for example, U.S. Pat. No. 3,715,208.

Moreover, color photographic light-sensitive materials having picture image-forming silver halide emulsion layers and sound image-forming silver halide emulsion layers containing compounds which do not form a picture image by the picture-imagewise exposure, but which split off non-diffusible silver bleach inhibitor on reacting with oxidation products of developing agents, as described in U.S. Pat. No. 3,705,801, can be used.

Color photographic light-sensitive materials having picture image-forming silver halide emulsion layers and silver halide emulsion layers containing as the silver bleach inhibitor compounds containing at least two oxyethylene groups, as described in U.S. Pat. No. 3,869,287 can also be used.

Color photographic light-sensitive materials having picture image-forming layers and silver halide emulsion layers containing nitrogen-containing heterocyclic compounds containing a thioether bond as the silver bleach inhibitor, as described in U.S. Pat. No. 3,940,271, can further be used.

Color photographic light-sensitive materials having picture image-forming silver halide emulsion layers and sound image-forming silver halide emulsion layers containing nitrogen-containing heterocyclic compounds containing nitrogen atoms which combine with groups containing 11 or more carbon atoms to form quaternary salts as the silver bleach inhibitor, as described in British Pat. No. 1,429,108 can in addition be used.

With any of the above described light-sensitive materials having sound track forming layers, the sound track-forming layers should not have a silver concentration so high that color reproduction is undesirably influenced after conventional picture image-forming exposure followed by conventional processings. That is, the presence of a great deal of silver in color images after conventional picture image-forming exposure followed by conventional processings produces color turbidity, which is harmful to accurate color reproduction.

In order to eliminate the production of silver images in the picture area, which are harmful from the standpoint of color reproduction, British Pat. No. 1,429,108, for example, describes that where the spectral sensitivity of the sound track-forming layer and that of the picture image-forming layer overlap, the former's sensitivity is reduced to not more than one fourth, preferably not more than one sixth, that of the latter's sensitivity. In accordance with this method, silver sound images in the sound track-forming layer which are obtained by picture image-forming exposure followed by conventional processings are formed only at the highest density area. These silver images formed, as a result, intensify black areas of the color picture images, and provide a rather desired effect from the standpoint of color reproduction. On the other hand, sound exposure through a sound original film for producing the optical sound track must be carried out at high illumination intensity as the sensitivities of the sound track-forming layers are low as described above. Therefore, when sound image-forming exposure is conducted, the picture image-forming silver halide emulsion layers of higher sensitivity are excessively exposed to light, thereby forming color sound images together with silver sound images at the sound track area. Since these color sound images are excessively exposed to light they are liable to lack sharpness, which is harmful from the standpoint of sound reproduction.

To remove the above faults, it is preferred that the spectral sensitivity of the sound track-forming layer be separate from that of the picture image-forming silver halide emulsion layers, i.e., it is ideal if the sound track-forming layer is not exposed to light by a common picture image-forming exposure, whereas the picture image-forming silver halide emulsion layer is not exposed to light by the sound image-forming exposure through the sound original film. Conventional subtractive multi-layer color photographic light-sensitive materials are produced by coating a first light-sensitive silver halide emulsion layer which has its sensitivity in the blue region of the spectrum, containing couplers which react with oxidation products of developing agents, thereby forming yellow dyes; a second light-sensitive silver halide emulsion layer which has its sensitivity in the red region of the spectrum, containing couplers which react with oxidation products of developing agents, thereby forming cyan dyes; and a third light-sensitive silver halide emulsion layer which has its sensitivity in the green region of the spectrum, containing couplers which react with oxidation products of developing agents, thereby forming magenta dyes. The formation of color images is carried out using these sensitivities to blue, red, and green of the spectrum. Therefore, if the spectral sensitivity of the optical sound track-forming layer is made distinct from that of the color picture image-forming silver halide emulsion layers and these layers are exposed to rays having different wave lengths, undesired superposition of silver picture images on color picture images and undesired superposition of color picture images on sound images can be prevented. As one such attempt, U.S. Pat. No. 3,737,312 proposes a color photographic light-sensitive material having a silver halide emulsion layer (optical sound track-forming layer) with spectral sensitivity in the spectral wavelength region where the spectral sensitivity of the color picture image-forming layer is lowest. In this case, the spectral wavelength region where the spectral sensitivity of the color picture image-forming layer is lowest is, in the case of conventional subtractive color photographic light-sensitive materials, in the range of about 470 nm to about 480 nm (between the blue region and the green region of the spectrum), and in the range of about 580 nm to about 660 nm (between the green region and the red region of the spectrum). Therefore, by setting the spectral sensitivity of the sound track-forming layer in the range of about 470 nm to about 480 nm or about 580 nm to about 600 nm, and by carrying out sound image-forming exposure with light of such a wave length, undesired superposition of picture silver images on color picture images is avoided. However, since light having a wave length of from about 580 nm to about 600 nm is used as a safety light for conventional subtractive color print rilms, if the spectral sensitivity of the sound track-forming layer is set in this range, the sound track-forming layer would be subjects to fogging by light of this wavelength region, used as safety light. For this reason, it is undesired that the spectral sensitivity of the sound track-forming layer be set in the range of about 580 nm to about 600 nm.

U.S. Pat. No. 3,737,312 describes that it is desired to set the spectral sensitivity of the sound track-forming layer to between about 470 nm and about 480 nm. However, as a matter of fact, in the region of about 470 nm to about 480 nm where the spectral sensitivity of the picture image-forming silver halide emulsion layers is lowest, the picture image-forming silver halide emulsion layers have relatively high sensitivity. Therefore, setting of the spectral sensitivity of the sound track-forming layer in this range inevitably causes undesired super-position of silver picture images on the color picture images, and undesired superposition of the color sound images on the silver sound images.

As a second method of eliminating the undesired superposition of silver images on color images and the undesired superposition of color sound images on silver sound images, it was considered to set the spectral sensitivity of the sound track-forming layer in the infrared region. The maximum spectral sensitivity of the sound track-forming layer to achieve the above object must be at a longer wave length region, i.e., at least 750 nm. However, spectral sensitizers capable of providing spectral sensitivity in the infrared region are generally unstable, and, moreover, light-sensitive materials subjected to spectral sensitization by the use of these spectral sensitizing dyes are unstable and practically unusable. Furthermore, exposure of the sound track-forming layer is naturally carried out using infrared light, and the selection of filters for obtaining such light is generally limited.

As a third method of eliminating the undesired superposition of silver picture images on color picture images and the undesired superposition of color sound images on silver sound images, it was considered to set the spectral sensitivity of the sound track-forming layer in the ultraviolet region. In general, the light-sensitive region of a light-sensitive silver halide emulsion itself ranges from the ultraviolet region to near 500 nm in the visible region. However, since binders for silver halide particles, generally gelatin, absorb light at the shorter wavelength side of the ultraviolet region, a light-sensitive silver halide emulsion is rarely sensitive at wave lengths shorter than 300 nm. Thus, undesired superposition of silver picture images on color picture images could be prevented by setting the spectral sensitivity of the sound track-forming layer at the spectral sensitivity region of the silver halide emulsion itself, by setting the wave length of light used to sound image-wise expose the sound track-forming layer to wave lengths shorter than about 400 nm, and by setting the wave length of light used to picture image-wise expose the color picture image-forming silver halide emulsion layers to wave lengths longer than about 400 nm, i.e., the visible region. Moreover, filters for obtaining these wave lengths are easily available. In more detail, the picture image-forming silver halide emulsion layers are initially exposed picture image-wise to light by the use of an ultraviolet ray absorbing filter (capable of absorbing rays having wave lengths shorter than about 400 nm) and the sound track-forming layer is then exposed sound image-wise to light using a visible ray absorbing filter (capable of absorbing rays having wave lengths longer than about 400 nm) from the sound original. In this case, however, since the picture image-forming silver halide emulsion layers also have sensitivity at wave lengths shorter than about 400 nm, when the sound track-forming layer is exposed to light the picture image-forming silver halide emulsion layer is simultaneously exposed to light, thereby producing an undesired superposition of color sound images on the silver sound images. In general, at wave lengths shorter than about 400 nm, the sensitivity of the blue light-sensitive silver halide emulsion layer containing yellow dye-forming couplers is highest of the color image-forming layers, and thus undesired superposition of color sound images on the silver sound images is most remarkable at yellow image areas.

The prevention of the undesired superposition of the color sound images on the silver sound images is achieved by interposing a layer containing an ultraviolet ray absorbing material between the support and the sound track-forming layer, i.e., when the sound track-forming layer is sound image-wise exposed to light using rays of wave lengths shorter than about 400 nm, latent images are formed in silver halide grains of the sound track-forming layer. Further, due to the action of the ultraviolet ray absorbing material, no latent image is formed in silver halide grains of the picture image-forming layer. Therefore, undesired superposition of the color sound images on the silver sound images produced by processing multi-layer color photographic light-sensitive materials carrying a sound track-forming layer can be eliminated.

On the other hand, exposure to form the color picture images using rays having wave lengths longer than about 400 nm as described above, i.e., to visible rays, reduces developable latent images formed in the silver halide emulsion of the sound track-forming layer, and thus makes it possible to reduce superposition of silver picture images on the color picture image section.

Since the above mentioned multi-layer color photographic light sensitive material carrying a sound track-forming layer has a layer in addition to the conventional picture image-forming layer, the former light-sensitive material has an increased total coating amount of silver compared with the latter light-sensitive material. The increased total coating amount of silver leads not only to the increased cost of production of the light sensitive material, but also to the decreased sharpnesss of picture images or sound images when a multi-layer color photographic light-sensitive material having a sound track-forming layer is used. That is, when a sound track-forming layer is coated as an outermost layer far from the support, the sharpness of picture images decreases by the irradiation due to the light scattering at the surface of silver halide grains in a sound track-forming layer. On the other hand, when a sound track-forming layer is coated as a layer adjacent to the support, the sound reproduction is insufficient due to decreased sharpness of sound images, though the sharpness of picture images remains unchangeable compared with a conventional multilayer color photographic light-sensitive material. To avoid the above disadvantages in a multi-layer light-sensitive silver halide material carrying a sound track-forming layer, it is preferable to decrease the coating amounts of silver in a sound track-forming layer. In order to decrease the coating amounts of silver in a sound track-forming layer, Japanese Pat. (OPI) No. 77334/1976 describes that the sound track-forming layer contains a silver bleach inhibitor and a heterocyclic thione compound incapable to enolize. U.S. Pat. No. 3,705,801 describes that a silver bleach inhibitor releasing coupler (BIR coupler) which reacts with a color developing agent to form a dye having a relatively longer wavelength absorption maximum, while a silver bleach inhibitor is released, is able to reduce the coating amount of silver in the sound track-forming layer. British Pat. No. 1,429,108 describes that a bleach inhibitor containing a heterocyclic nitrogen atom and a coupler capable of reacting with an oxidation product of a color developing agent can be advantageously used to form a dye whose absorption maximum is at a wavelength longer than 725 nm, so that the coating amount of silver in the sound track forming layer can be reduced.

SUMMARY OF THE INVENTION

One object of the present invention is to provide a novel process which enables one to produce a color photograph having an optical sound track without conducting any sound development.

Another object of the present invention is to provide a novel process which enables one to produce a color photograph having an optical sound track without conducting any sound development using a multi-layer color photographic material having a less coating amount of silver.

Another object of the present invention is to provide a novel color photographic light-sensitive material which enables one to produce a color photograph having an optical sound track without conducting any sound development.

A further object of the present invention is to provide a color photographic light-sensitive material having improved color reproducibility which requires no sound development.

Still another object of the present invention is to provide a color photographic light-sensitive material able to form sound track having improved sound properties which requires no sound development.

These objects are attained by producing a multi-layer color photographic light-sensitive material which comprises a support, at least one blue-sensitive silver halide emulsion layer containing one or more yellow dye-forming couplers, at least one red-sensitive silver halide emulsion layer containing one or more cyan dye-forming couplers, at least one green-sensitive silver halide emulsion layer containing one or more magenta dye-forming couplers, and at least one ultraviolet-sensitive silver halide layer containing one or more non-diffusible silver bleach inhibitors, and one or more infrared couplers which react with an oxidation product of an aromatic primary amine developing agent to form dyes having an absorption maximum at a wavelength longer than 725 nm, wherein at least one layer interposed between the support and the ultraviolet-sensitive silver halide emulsion layer contains one or more non-diffusible ultraviolet ray absorbing materials; and by subjecting the multi-layer color photographic light-sensitive material, after ultraviolet ray exposure of the optical sound track area of the multi-layer color photographic light-sensitive material and after the visible light exposure of the color picture image-forming area thereof, to photographic processings which do not include any sound development stage.

Other objects and advantages of the present invention will become apparent from the following detailed description.

BRIEF DESCRIPTION OF THE DRAWINGS

FIG. 1-*b* is an illustrative view of a film produced by ultraviolet ray exposure of the sound track area of the light-sensitive material of FIG. 1-*a* and visible light exposure of the picture image area thereof, and then photographically processing the same.

FIG. 2-*b* is an illustrative view of a film produced by subjecting the light-sensitive matrial of FIG. 2-*a* to the same exposure and photographic processings as were used in the case of FIG. 1-*a*.

FIGS. 3-*b*, 4-*b*, 5-*b*, and 6-*b* are illustrative views of films produced by subjecting the light-sensitive materials of FIGS. 3-*a*, 4-*a*, 5-*a*, and 6-*a* to the same exposure and photographic processings as were used in the case of FIG. 1-*a*.

Figure 1A:
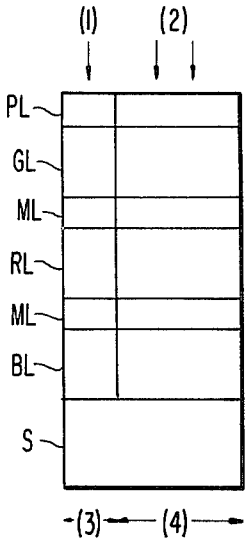
FIG. 1-*a* is a sectional view of a prior art multi-layer color photographic light-sensitive material prior to processing.

In these figures, (1), (2), (3), and (4) designate, respectively, ultraviolet ray exposure, visible light exposure, the sound track area, and the color picture image area. The symbols used in these figures have the following meanings:

S . . . Support
BL . . . Blue-sensitive silver halide emulsion layer containing yellow dye-forming coupler(s)
ML . . . Gelatin intermediate layer
RL . . . Red-sensitive silver halide emulsion layer containing cyan dye-forming coupler(s)
Gl . . . Green-sensitive silver halide emulsion layer containing magenta dye-forming coupler(s)
UL . . . Ultraviolet-sensitive silver halide emulsion layer containing silver bleach inhibitor(s) and infrared coupler(s)
PL . . . Gelatin protective layer
U . . . Ultraviolet ray absorbing agent Shaded parts (oblique lines) indicate color picture images formed in each of the layers, and shadowed parts (crossed oblique lines) indicate silver sound images.

DETAILED DESCRIPTION OF THE INVENTION

In accordance with one embodiment of the present invention, a light-sensitive material comprises a support, a first silver halide emulsion layer which has light-sensitivity in the blue visible region containing at least one coupler capable of reacting with oxidation products of color developing agents to form a yellow dye-image, a second silver halide emulsion layer which has light-sensitivity in the red visible region, containing at least one coupler capable of reacting with oxidation products of color developing agents to form a cyan dye image, a third silver halide emulsion layer which has light-sensitivity in the green visible region, containing at least one coupler capable of reacting with oxidation products of color developing agents to form a magneta dye image, and a fourth sound image-forming silver halide emulsion layer having ultraviolet sensitivity, containing at least one silver bleach inhibitor, and at least one coupler capable of reacting with oxidation products of color developing agents to form a dye which has a absorption maximum at a wavelength longer than 725 nm, all of these layers being superposed on the support although not limited to the recited order, wherein at least one of the layers interposed between the support and the fourth silver halide emulsion layer contains at least one ultraviolet ray absorbing agent. This layer containing at least one ultraviolet ray absorbing agent may be any one of the first, second, or third emulsion layers, and, furthermore, may be an intermediate layer having no light-sensitivity. The ultraviolet ray absorbing material(s) may be incorporated into either one layer or two or more layers.

When such a multi-layer color photographic material is subjected to image-wise exposure using visible light from a suitable picture image original, subjected to sound image-forming exposure using ultraviolet rays from a suitable sound image original, and then subjected to color development, yellow dye images and silver images are formed in the first silver halide emulsion layer, cyan dye images and silver images are formed in the second silver halide emulsion layer, magenta dye images and silver images are formed in the third silver halide emulsion layer, and infrared dye images and silver images are formed in the fourth silver halide emulsion layer containing silver bleach inhibitors and infrared couplers. When the resulting light-sensitive material is subjected to fixing to remove unexposed silver halide and then to bleaching, silver images formed in the first, second, and third silver halide emulsion layers are bleached, whereas silver images formed in the fourth silver halide emulsion layer remain unbleached due to the action of the silver bleach inhibitors. Thus, a color photographic element containing dye picture images and infrared dye sound images and silver sound images can be obtained.

A preferred light-sensitive material of the present invention is produced by coating on a support a blue-sensitive silver halide emulsion layer containing at least one yellow dye-forming coupler, a red-sensitive silver halide emulsion layer containing at least one cyan dye-forming coupler and at least one ultraviolet ray absorbing agent, a green-sensitive silver halide emulsion layer containing at least one magenta dye-forming coupler and an ultraviolet sensitive silver halide emulsion layer containing at least one silver bleach inhibitor, and at least one infrared coupler in the recited order. In this case, the ultraviolet-sensitive silver halide emulsion layer containing at least one silver bleach inhibitor may be interposed between the red-sensitive silver halide emulsion layer containing at least one cyan dye-forming coupler and the green-sensitive silver halide emulsion layer containing at least one magenta dye-forming coupler, and intermediate layers may be interposed between each of the light-sensitive silver halide emulsion layers. At least one ultraviolet ray absorbing agent may be incorporated into any one or all of the layers interposed between the silver halide emulsion layer containing at least one silver bleach inhibitor and at least one infrared coupler and the support. For example, they may be incorporated into the blue-sensitive silver halide emulsion layer containing at least one yellow dye-forming coupler, or the above described intermediate layer, or they may be incorporated into two or more layers at the same time.

Another preferred light-sensitive material of the present invention is produced by coating on a support a red-sensitive silver halide emulsion layer containing at least one cyan dye-forming coupler, a green-sensitive silver halide emulsion layer containing at least one magenta dye-forming coupler, a yellow filter layer containing yellow colloidal silver or at least one yellow dye, a blue-sensitive silver halide emulsion layer containing at least one yellow dye-forming coupler and at least one ultraviolet ray absorbing agent, and an ultraviolet-sensitive silver halide emulsion layer containing at least one silver bleach inhibitor and at least one infrared coupler, in the recited order. In this case, between each of the light-sensitive silver halide emulsion layers, or between the light-sensitive silver halide emulsion layer and the yellow filter layer there may be interposed an intermediate layer. Moreover, at least one ultraviolet ray-absorbing agents may be incorporated into two or more layers at the same time.

Figure 1B:
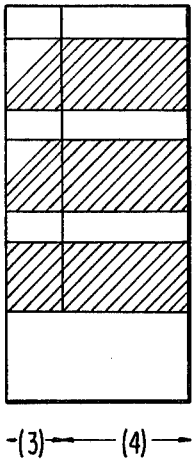
Figure 2A:
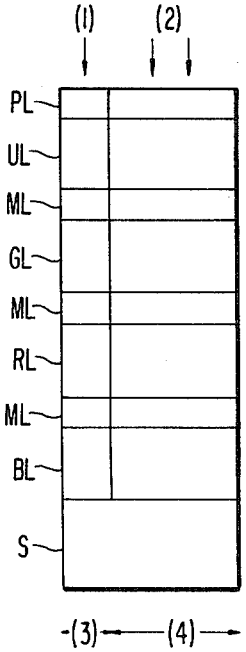
FIG. 2-*a* is a sectional view of a multi-layer color photographic light-sensitive material containing a silver bleach inhibitor and a infrared coupler prior to processing.
Figure 2B:
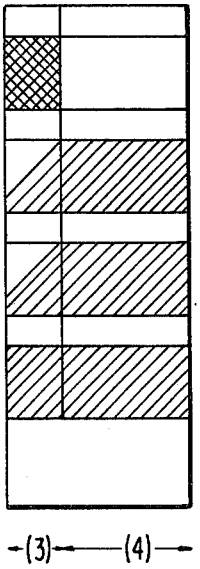
Figure 3A:
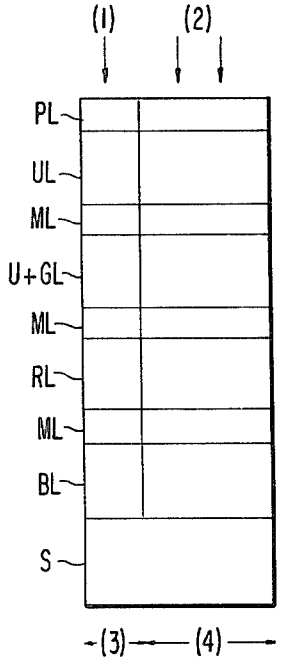
FIGS. 3-*a*, 4-*a*, 5-*a*, and 6-*a* are sectional views of multi-layer color photographic light-sensitive materials of the present invention prior to processing.
Figure 3B:
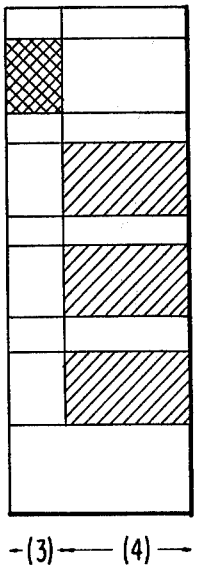
Figure 4A:
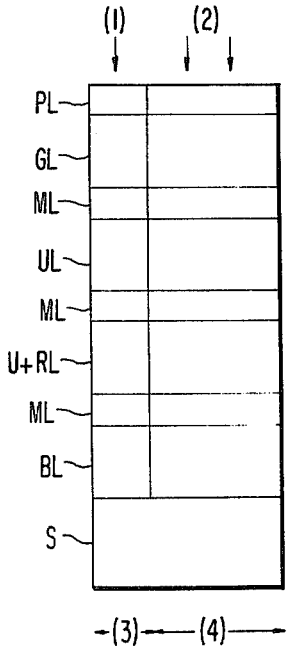
Figure 4B:
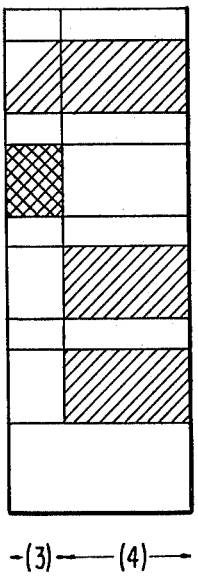
Figure 5A:
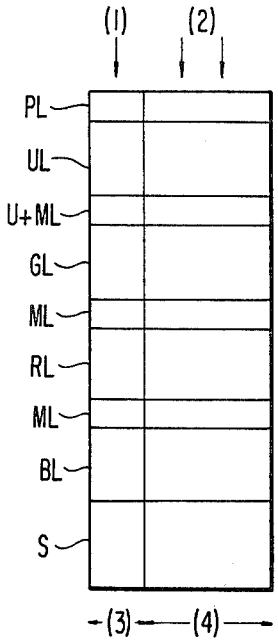
Figure 5B:
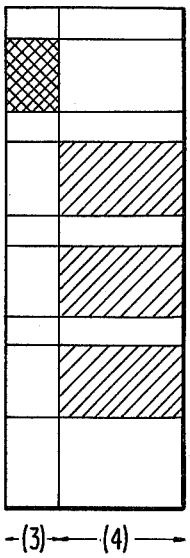
Figure 6A:
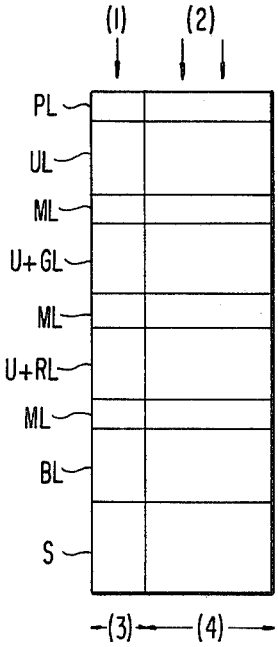
Figure 6B:
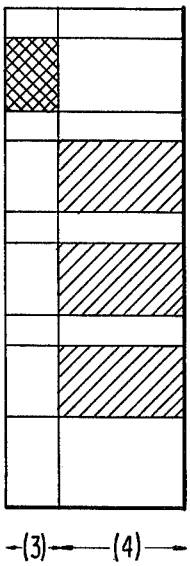

Light-sensitive materials of the present invention, a method of producing color photographs having optical sound track by the use of these light-sensitive materials, and conventional light-sensitive materials, and a method of producing color photographs by the use of such light-sensitive materials are illustrated in FIGS. 1*a*, 1*b*, 2*a*, 2*b*, 3*a*, 3*b*, 4*a*, 4*b*, 5*a*, 5*b*, 6*a* and 6*b*.

FIG. 1-*a* is a sectional view of a multi-layer color photographic light-sensitive material of the prior art prior to any processings. An illustrative view of a film produced by exposing the sound track section of the multi-layer color photographic light-sensitive material of FIG. 1-*a* to ultraviolet rays, by exposing the picture image area thereof to visible lights, and then by subjecting the resulting light-sensitive material to photographic processing is shown in FIG. 1-*b*. In this case, since no sound development is conducted, no silver image is formed in the sound track section after the processing. Moreover, since all of the three color image-forming silver halide emulsion layers have light-sensitivity to visible light and ultraviolet rays, dye images are formed both in the sound track section and in the picture image area section. Generally, the blue-sensitive silver halide emulsion layer has high sensitivity, and the green-sensitive silver halide emulsion layer and the red-sensitive silver halide emulsion layer have lower light-sensitivities, as compared to the blue-sensitive silver halide emulsion layer, to ultraviolet rays. Generally, it is preferred that the sensitivity to ultraviolet rays of the blue sensitive silver halide emulsion layer of a color print film be about 30 to about 200 times higher than that of the green sensitive or red sensitive silver halide emulsion layers. Accordingly, in the sound track area exposed to ultraviolet rays, yellow dye images are mostly formed, and some cyan dye images and magenta dye images are formed, which are of substantially no use for the reasons as described above. The term "sound track" as used herein designates a portion of a movie film, and its position and size for 35 mm films, for example, as described in American Standard PH 22,40-1967, and those for 16 mm films as described in pH 22,41-1969.

FIG. 2-*a* is a sectional view of a multi-layer color photographic light-sensitive material containing at least one silver bleach inhibitor. If this multi-layer color photographic light-sensitive material is exposed and processed in the same manner as described in FIG. 1-*a*, a film can be obtained which is schematically illustrated in FIG. 2-*b*. With this light-sensitive material, silver sound images are formed in the sound track area by the action of the silver bleach inhibitor in the sound track-forming layer without conducting any sound development and infrared dye sound images in the sound track area. However, for the reasons as described in FIG. 1, color picture images overlying the silver sound images and the infrared dye sound images in the sound track area are formed.

FIGS. 3-*a*, 4-*a*, 5-*a*, and 6-*a* are sectional views of multi-layer color photographic light-sensitive materials of the present invention prior to processing. In these light-sensitive materials, at least one ultraviolet ray absorbing agent is incorporated in the green-sensitive silver halide emulsion layer, the red-sensitive silver halide emulsion layer and an intermediate layer in contact with the green-sensitive silver halide emulsion layer. The embodiments shown in these Figures are illustrative of the present invention, and it is to be noted that the present invention is not intended to be limited thereto. Illustrative views of films produced by processing these light-sensitive materials are shown in FIGS. 3-*b*, 4-*b*, 5-*b*, and 6-*b*, respectively. With these light-sensitive materials, the superposition of picture dye images on silver sound images and infrared dye sound images in sound track area is greatly reduced, and, thus, as described above, desired results from the viewpoint of sound reproduction are obtained. Moreover, superposition of silver sound images and infrared dye sound images on dye picture images in the picture image area is low, and thus desired results from the viewpoint of color reproduction are obtained.

Any conventional ultraviolet ray-absorbing material can be used in the light-sensitive materials of the present invention so long as it is non-diffusible and capable of absorbing substantially all of the ultraviolet rays (inorganic or organic compounds and exerts no harmful influence on photographic properties). Ultraviolet ray-absorbing materials are those which provide a layer which has an optical density (i.e., $D_{max}$) of preferably not less than 1.0 at the maximum absorption wavelength of the material in the layer containing the same. Therefore, in addition to those compounds generally called ultraviolet ray absorbing agents, couplers capable of absorbing ultraviolet rays, e.g., α-naphthol based cyan dye-forming couplers as disclosed in U.S. Pat. No. 3,617,291 and British Pat. No. 1,382,861, and polymers capable of absorbing ultraviolet rays can be used, as disclosed in U.S. Pat. Nos. 3,615,547, 3,676,139, 3,615,544, and 3,677,762.

Examples of ultraviolet ray absorbing agents which can be conveniently used in the present invention include benzotriazoles wherein the nitrogen atom at the 2-position is substituted by a phenyl group, e.g., benzotriazole compounds represented by the following formula I (see U.S. Patent No. 3,253,921):

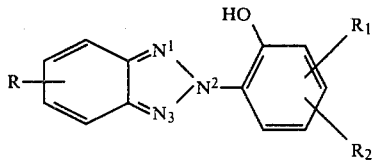

(I)

wherein R, $R_1$, and $R_2$ each represent a hydrogen atom, a halogen atom, e.g., a chlorine, bromine or iodine atom, etc., a nitro group, an alkyl group having 1 to 18 carbon atoms (which term includes unsubstituted and substituted alkyl groups, e.g., a methyl, ethyl, propyl, isopropyl, aminopropyl, butyl, sec-butyl, chlorobutyl, etc. group), an alkoxy group having 1 to 18 carbon atoms in the alkyl moiety thereof (which term includes unsubstituted and substituted alkoxy groups, e.g., methoxy, propoxy, chlorobutoxy, carbomethoxy, etc., groups) an aryl group (which term includes unsubstituted and substituted phenyl groups, e.g., phenyl, p-tolyl, 4-ethoxyphenyl, 2-hexoxyphenyl, etc., group) an aryloxy group (which includes both unsubstituted and substituted phenoxy groups) as described in U.S. Pat. Nos. 3,253,921 and 3,533,794; 4-thiazolidone compounds as described in U.S. Pat. Nos. 3,314,794, 3,507,858 and 3,352,681, and British Pat. No. 1,054,120; benzophenone compounds as described in U.S. Pat. No. 3,215,530 and British Pat. No. 926,454; cinnamate compounds as described in U.S. Pat. Nos. 3,462,475 and 3,215,540, British Pat. No. 949,181 and W. German Patent (OLS) No. 2,049,289; benzoxazole compounds as described in British Pat. No. 901,648, W. German Pat. (DAS) No. 1,597,551 and Japanese Pat. No. 27,525/65; and the like. Superior results are obtained when the ultraviolet ray absorbing agent(s) is present in an amount of from about $10^{-2}$ to about $10^{-1}$ g/m$^2$, more preferably 0.1 to 2 g/m$^2$ and when the ultraviolet absorbing layer provides about a 50% to about a 0.1% optical transmittance (about 0.3 to about 3 optical density).

Examples of silver bleach inhibitors which can be used in the present invention include compounds as described in U.S. Pat. No. 3,715,208 (e.g., thiol compounds), compounds capable of reacting with oxidation products of developing agents to release non-diffusible silver bleach inhibitors as described in U.S. Pat. 3,705,801, compounds containing at least two oxyethylene groups as described in U.S. Pat. No. 3,869,287, nitrogen-containing heterocyclic compounds containing thioether bonds as described in U.S. Pat. No. 3,940,271, nitrogen-containing heterocyclic compounds containing nitrogen atoms which combine with groups containing 11 or more carbon atoms to form a quaternary salt as described in British Pat. No. 1,429,108, and the like. Superior results are obtained when the silver bleach inhibitor is present in an amount of from about $10^{-1}$ to about $10^2$ g per mole of silver halide. The infrared couplers according to this invention is a coupler which can react with an oxidation product of an aromatic primary amine color developing agent to form a dye whose absorption maximum is at a wavelength longer than 725 mm. Suitable examples of such infrared couplers are shown by general formulae (II), (III) and (IV).

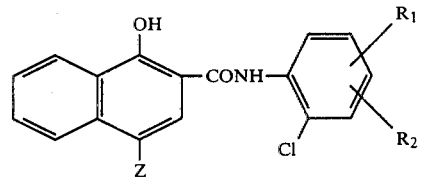

(II)

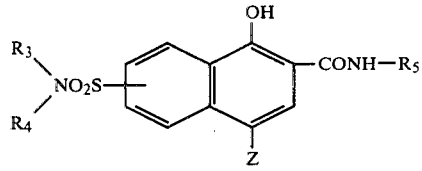

(III)

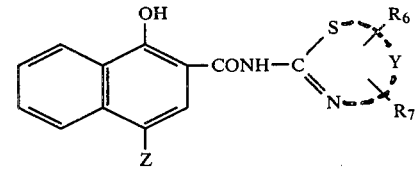

(IV)

wherein Z represents a hydrogen atom or a coupling-off group (for example, a halogen atom, a thiocyano group, an acyloxy group, an alkoxy group, an aryloxy group, an alkylthio group, an arylthio group, a cyclic imido group, etc.); Y represent non-metallic atoms necessary to complete a thiazole or benzothiazole nucleus; $R_1$ represents a hydrogen atom or a more electron attractive group than a hydrogen atom (for example, halogen atom, etc.); $R_3$ and $R_4$ each represent a hydrogen atom or an alkyl group having 1 to 20 carbon atoms, each may be same or different, $R_5$ represents an alkyl group or an alkenyl group having 12 or more carbon atoms, or a

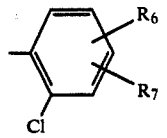

group; $R_6$ represents a hydrogen atom, a lower alkyl group having 1 to 4 carbon atoms or an alkoxycarbonyl group having 1 to 4 carbon atoms; and $R_2$ and $R_7$ each represent a ballast group having 6 or more carbon atoms, each may be bonded to the phenyl nuclei either directly or via an amino bond, an ether bond, a thioether bond, a carbonamide bond, a sulphonamide bond, a urea bond, an ester bond, an imide bond a carbonyl bond or a sulphonyl bond.

Examples of the above ballast groups include the following groups (alkyl groups are normal unless otherwise indicated).

(i) Alkyl and alkenyl groups:

For example,

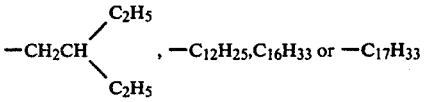

(ii) Alkoxyalkyl groups:

For example,

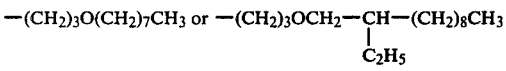

as described in Japanese Patent Publication 27563/64

(iii) Alkylaryl groups:

For example,

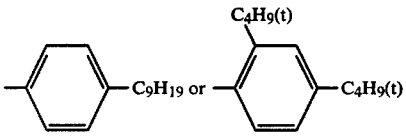

(iv) Alkylaryloxyalkyl groups:

For example,

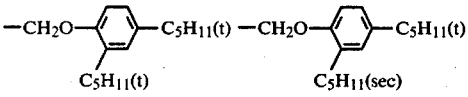

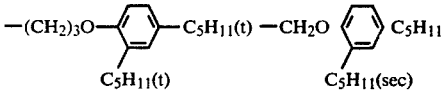

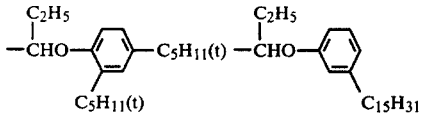

-continued

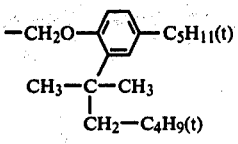

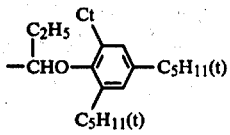

(v) Acylaminoalkyl groups:

For example,

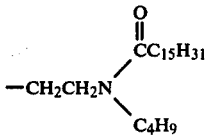

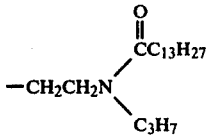

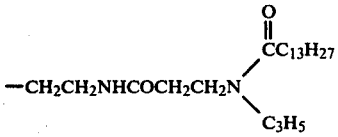

as described in U.S. Pat. Nos. 3,337,344 and 3,418,129.

(vi) Alkoxyaryl and aryloxyaryl groups:

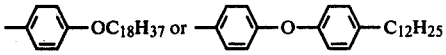

(vii) Residual groups containing an aliphatic group, such as an alkyl and/or an alkenyl group, having at least 8 carbon atoms, together with a carboxyl or a sulfo group:

For example,

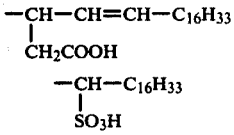

(viii) Alkyl groups substituted with an ester group:

For example,

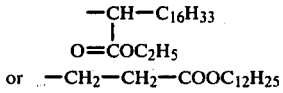

(ix) Alkyl groups substituted with an aryl group or a heterocyclic group:

For example

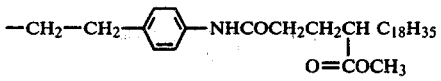
or
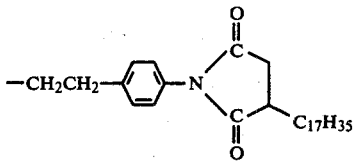
(x) Aryl groups substituted with an aryloxyalkoxycarbonyl group:
For example,
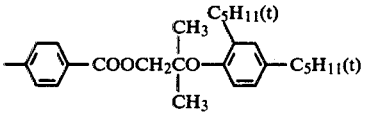
Suitable examples of infrared dye-forming couplers represented by general formula II include couplers shown below.
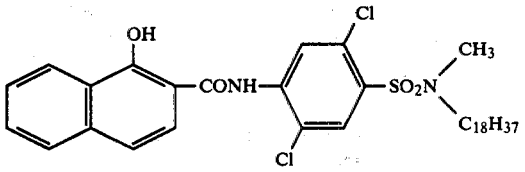
II-1
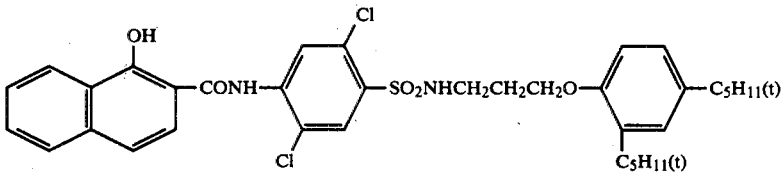
II-2
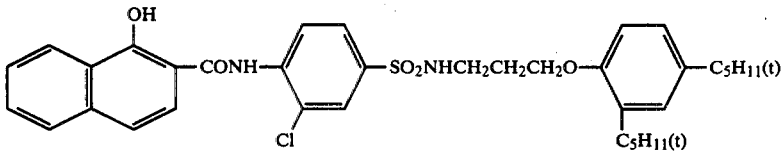
II-3
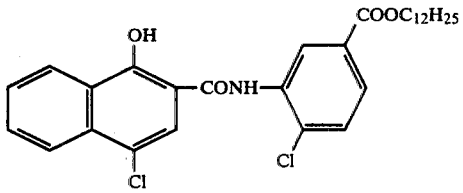
II-4
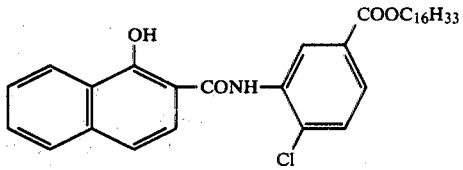
II-5
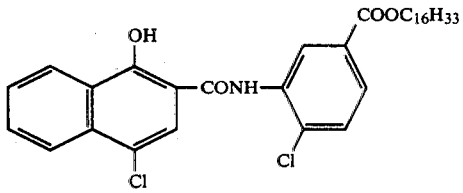
II-6
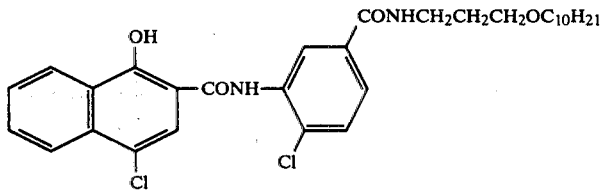
II-7
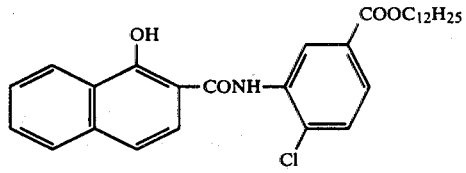
II-8

-continued
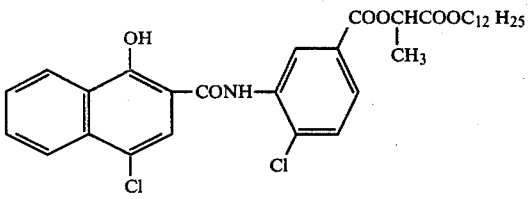
II-9
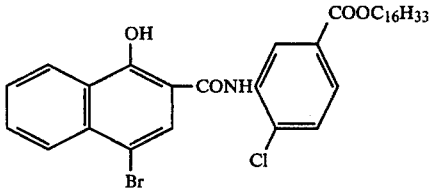
II-10
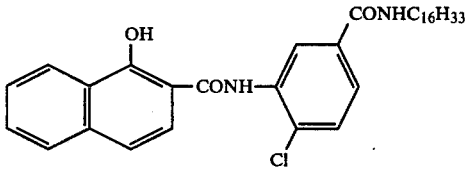
II-11
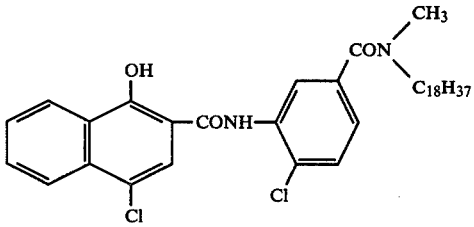
II-12
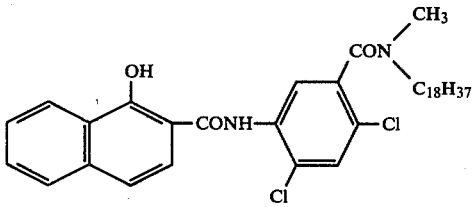
II-13
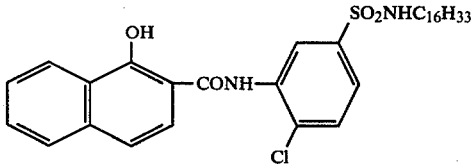
II-14
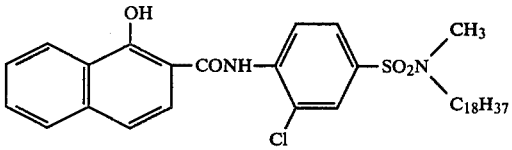
II-15
Suitable examples of infrared dye-forming couplers represented by general formula III include couplers shown below.
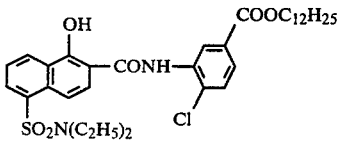
III-1
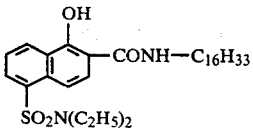
III-2
-continued
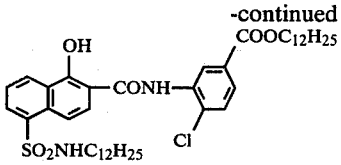
III-3
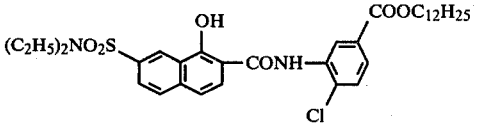
III-4
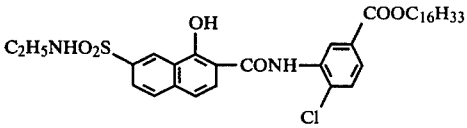
III-5

-continued

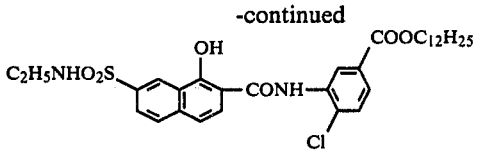

III-6

Suitable examples of infrared dye-forming couplers represented by general formula IV include couplers shown below.

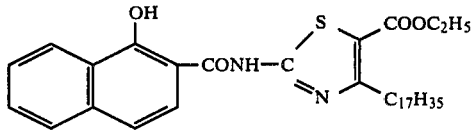

IV-1

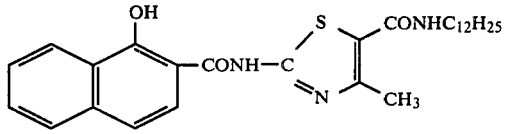

IV-2

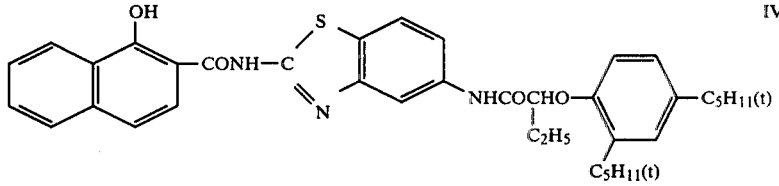

IV-3

The multi-layer color photographic light-sensitive material according to this invention contains a non-diffusible silver bleach inhibitor or a compound capable of releasing a non-diffusible silver bleach inhibitor and an infrared dye-forming coupler which can react with an oxidation product of a color developing agent to form a dye whose absorption maximum is at a wavelength longer than 725 nm, and an ultraviolet absorbing agent. An ultraviolet absorbing agent and an infrared dye-forming coupler are not restricted within the above general formula I, II, III and IV.

The amount of the ultraviolet absorbing agent of the invention will vary depending on the characteristics of the ultraviolet absorbing agent, but generally it is about $1\times10^{-2}$ g to about 10 g/m$^2$, preferably $1\times10^{-1}$ g to 5 g/m$^2$.

The amount of the infrared dye-forming coupler of the invention will vary depending on the characteristics of the infrared dye-forming coupler per se and the picture image dye-forming coupler. The amount of the infrared dye-forming coupler represented by general formula II, III, and IV is about $10^{-4}$ to about $10^{-1}$ mole/m$^2$, preferably $10^{-3}$ to $10^{-2}$ mole/m$^2$.

As ultraviolet ray absorbing filters for use in the color picture image-forming exposure of light-sensitive materials of the present invention, any filter can be used so long as it absorbs rays having wave lengths shorter than about 400 nm, and such filters are commonly available. For this purpose, the following filters are illustrative of suitable ones: Fuji Filter SC-39, Fuji Filter SC-40, Fuji Filter SC-41, Kodak Wratten Filter 2A, Kodak Wratten Filter 2C, etc.

As color separation filters for color picture image-forming exposure, conventional subtractive color separation filters can be advantageously used. Moreover, for color image-forming exposure, additive color printer using a dichroic mirror can be advantageously used. The above described ultraviolet ray absorbing filters can be advantageously used as filter packs both in subtractive color printing and additive color printing. A filter pack is a filter used to roughly correct the color balance and the density of a color print over all scenes in a motion picture print; a filter pack is distinguished from a filter which is used to exactly correct the color balance and density of a motion picture print on a scene-to-scene basis.

As visible light-absorbing filters for use in the sound image-forming exposure of light-sensitive materials of the present invention, any filter can be used so long as it absorbs rays having wave lengths longer than about 400 nm and transmits rays having wave lengths shorter than about 400 nm, and these filters are commonly available. In this case, those filters which transmit infrared rays having wave lengths longer than about 700 nm and ultraviolet rays having wave lengths shorter than about 300 nm can be used because light-sensitive materials are substantially insensitive in these regions. For this purpose, the following filters are illustrative of suitable ones: Wratten 18A, Toshiba Glass Filter UV-DIC, UV-D2, UV-D25, etc.

For the ultraviolet ray absorbing filters and the visible light-absorbing filters, respectively, the greater the degree of ultraviolet ray absorption and the greater the degree of visible light absorption (with, correspondingly, greater visible light passage and greater ultraviolet light passage), the more preferred are such filters.

The hydrophilic colloids used in the present invention are conventional in the art and include proteins such as gelatin, albumin, casein, and the like, cellulose derivatives such as carboxymethyl cellulose, hydroxyethyl cellulose, and the like, sugar derivatives such as agar-agar, sodium alginate, starch derivatives, and the like, synthetic hydrophilic colloids such as polyvinyl alcohol, poly N-vinyl pyrrolidone, polyacrylic acid copolymers, polyacrylamide, derivatives thereof, etc. These colloids can be used in combination with each other if desired. Of these colloids, gelatin is most conveniently used, but part or all of the gelatin can be replaced by other synthetic polymer materials. That is, part or all of gelatin can be replaced by compounds that react with a gelatin functional group, e.g., amino group, imino group, hydroxy group or carboxy group or replaced by a graft polymer produced by grafting a molecular chain of another polymer material onto functional groups of a gelatin backbone.

Light-sensitive silver halide emulsions as are used herein are produced by emulsifying a conventional silver halide such as silver chloride, silver bromide, silver iodide, silver chlorobromide, silver iodobromide, silver chloroiodobromide or mixtures thereof in a hydrophilic colloid as described above by any well known conventional method. It is advantageous to use a single jet process, a double jet process, a controlled double jet process, or a like process, for example, based on an ammonia process, a neutral process, an acid process, or the like, to produce the emulsion. Two or more silver halide emulsions produced individually may be mixed. Methods of producing emulsions are described in C. E. K. Mees, *The Theory of the Photographic Process,* published by Macmillan Co., P. Glafkides, *Photographic Chemistry,* published by Fountain Press Co., etc.

It is well known that the light-sensitivity of a light-sensitive silver halide emulsion varies depending upon the halide composition thereof. That is, the long wavelength end of the spectral sensitivity of a silver chloride emulsion is about 410 nm, that of a silver bromide emulsion is about 470 nm, and that of a silver iodobromide emulsion is about 530 nm, although it changes according to the iodide content (see C. E. K. Mees, *The Theory of the Photographic Process,* published by Macmillan Co., page 199).

Where the long wavelength end of the spectral sensitivity of the light-sensitive silver halide emulsion used in the sound track-forming layer of the light-sensitive material of the present invention is over 480 nm, the silver halide emulsion in the sound track-forming layer is exposed by a picture imade-forming exposure using visible light, which results in an increase in the superposition of silver picture images on the dye image area finally obtained. Accordingly, it is desired that developable latent images formed on exposure of the light-sensitive silver halide emulsion in the sound track-forming layer to visible light be minimized. Therefore, it is preferred that among the above described light-sensitive emulsions those emulsions having low light-sensitivity to visible light be used in the sound track-forming layer, most preferably those substantially not absorbing visible light, for example, light of about 400 to about 460 nm, in wave length. For this purpose, for example, it is desired that the bromide content of the light-sensitive silver halide of the sound track-forming layer not exceed about 60 mole %, preferably not exceed 40 mole %, and the iodide content not exceed about 1 mole %, preferably not exceed 0.5 mole %. The use of such silver halide compositions makes it possible to produce light-sensitive silver halide emulsions for the formation of a sound track which are low or substantially low in visible light sensitivity and high in ultraviolet sensitivity. With regard to the halide composition of light-sensitive silver halide emulsions for use in the picture image-forming silver halide emulsion layer, there is no preferred limited range as described above, and silver chloride, silver bromide, silver iodide, silver chlorobromide, silver iodobromide, silver chlorobromide, silver chloroiodobromide, or mixtures thereof can be advantageously used.

The visible or UV light-sensitive silver halide emulsions of the present invention can be chemically sensitized by active gelatin, or by the methods as described in U.S. Pat. Nos. 1,574,944, 1,623,499, and 2,410,689, if desired. The visible or UV light-sensitive silver halide emulsions of the present invention can be sensitized with noble metal salts such as palladium salts or gold salts as described in U.S. Pat. Nos. 2,488,060, 2,399,083, and 2,642,361, if desired. The visible light-sensitive silver halide emulsions of the present invention may also be spectrally sensitized with cyanine or merocyanine dyes as described in U.S. Pat. Nos. 2,519,001, 2,666,761, 2,734,900, 2,739,964, and 3,481,742, if desired.

Moreover, the visible or UV light-sensitive silver halide emulsions of the present invention can be subjected to reduction-sensitization using reducing agents such as stannous salts as described in U.S. Pat. No. 2,487,850, or polyamines as described in U.S. Pat. Nos. 2,518,698 and 2,521,925, if desired.

Furthermore, the visible or UV light-sensitive silver halide emulsions of the present invention can be stabilized by the use of antifoggants or stabilizers. For this purpose, azaindenes, mercaptotetrazoles, salts of noble metals such as palladium, platinum, and the like, oximes, imidazolium salts, tetrazolium salts, etc., can be used. These compounds are described in U.S. Pat. Nos. 2,444,605, 2,886,437, 2,403,927, 3,266,897, 3,399,987, 2,597,915, 3,566,265, 2,694,716, 994,869, etc.

The visible or UV light-sensitive materials of the present invention may contain plasticizers such as glycerin, auxiliary coating agents such as saponin or those as described in U.S. Pat. Nos. 3,415,649, 3,441,413, 3,502,473, 3,514,293, 3,506,449, 3,539,352, 3,545,974, 3,507,660, 3,442,654, 3,475,174, 3,462,520, 3,493,379, 3,516,833, 3,516,835, 3,589,906, 3,617,292, 3,619,199, 3,663,229, etc., if desired.

The light-sensitive materials of the present invention may contain conventional antistatic agents such as those compounds described in U.S. Pat. Nos. 3,428,456, 3,437,484, 3,457,076, 3,549,375, 3,549,369, 3,551,152, 3,552,972, 3,547,643, 3,564,043, 3,615,531, 3,625,695, 2,131,038, 2,518,698, 3,369,904, 2,419,974, 2,419,975, British Pat. No. 623,448, etc.

Hydrophilic colloids for use in light-sensitive materials of the present invention may be hardened with conventional hardening agents such as an aldehydes, methylols, 1, 4-dioxanes, aziridines, isooxazoles, carbodiimides, active halogens, active vinyl compounds, and the like, if desired. Representative examples of such hardening agents are described in U.S. Pat. Nos. 3,232,764, 3,288,775, 2,732,303, 3,635,718, 3,232,763, 2,732,316, 2,586,168, 3,103,437, 3,017,280, 2,983,611, 2,725,294, 2,725,295, 3,100,704, 3,091,537, 3,321,313, 3,543,292, British Pat. Nos. 974,723, 1,167,207, 3,655,387, 3,653,906, 3,655,386, 3,686,368, 3,756,828, 3,754,924, etc.

The light-sensitive materials of the present invention may contain conventional filter dyes or anti-irradiation dyes such as those compounds described in U.S. Pat. Nos. 2,274,782, 2,527,583, 2,956,879, 3,177,078, 3,252,921, and Japanese Pat. No. 22,069/1964. These dyes may be subjected to mordanting by the method as described in U.S. Pat. No. 3,282,699, for example.

The light-sensitive materials of the present invention may contain conventional anti-stain agents such as the hydroquinone derivatives as described in U.S. Pat. Nos. 2,360,290, 2,336,327, 2,384,658, 2,403,721, 2,418,613, 2,675,314, 2,701,197, 2,704,713, 2,728,659, 2,732,300, 2,735,765, etc.

In light-sensitive materials of the present invention any conventional open chain ketomethylene yellow dye-forming coupler can be advantageously used. Representative examples of these couplers are benzoylacetanilide, pivaloyl acetanilide, or like couplers. In addition, any conventional magenta dye-forming coupler such as pyrazolone, indazolone, and like couplers can be advantageously used. Moreover, any conventional cyan dye-forming couplers such as phenol type, naphthol type, or like couplers can be advantageously used. These couplers can further contain conventional coupling releasable groups at a carbon atom of their active methylene or methine atoms to be coupled, if desired.

Representative examples of non-diffusible couplers which can be used in the present invention, will be described below.

As yellow dye-forming couplers, open chain diketomethylene couplers are conveniently used. Examples of such are described in U.S. Pat. Nos. 3,341,331, 2,875,057, 3,551,155, German Pat. (OLS) No. 1,547,868, U.S. Pat. Nos. 3,265,506, 3,582,322, 3,725,072, German Pat. (OLS) No. 2,162,899, U.S. Pat. Nos. 3,369,895, 3,408,194, German Pat. (OLS) Nos. 2,057,941, 2,213,461, 2,219,917, 2,261,361, 2,263,875, etc.

As magenta dye-forming couplers, 5-pyrazolone couplers are mostly used, but indazolone and cyanoacetyl couplers can be used, if desired. Examples of such are described in U.S. Pat. Nos. 2,439,098, 2,600,788, 3,062,653, 3,558,319, British Pat. No. 956,261, U.S. Pat. Nos. 3,582,322, 3,615,506, 3,519,429, 3,311,476, 3,419,391, Japanese patent applications Nos. 21454/1973 (corresponding to U.S. Pat. No. 3,935,015), 56050/1973 (corresponding to British Pat. No. 1,470,552), German Pat. No. 1,810,464, Japanese Pat. No. 2,016/1969, Japanese patent application No. 45971/1973, U.S. Pat. No. 2,983,608, etc.

As cyan dye-forming couplers, phenol or naphthol derivatives are mainly used. Examples of such compounds are described in U.S. Pat. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034,982, 3,583,971, German Pat. (OLS) No. 2,163,811, Japanese Pat. No. 28836/1970, Japanese patent application No. 33238/1973 (corresponding to U.S. Pat. No. 29,379), etc.

In addition, couplers releasing development-inhibitors upon dye-forming (DIR couplers), or compounds releasing development inhibitors (DIR compounds) can be added to any desired photographic layer. Examples of such DIR couplers or DIR compounds are described in U.S. Pat. Nos. 3,148,062, 3,227,554, 3,253,924, 3,617,291, 3,622,328, 3,705,201, British Pat. No. 1,201,110, U.S. Pat. Nos. 3,297,445, 3,379,529, 3,639,417, Japanese patent applications Nos. 33238/1973 (corresponding to U.S. Pat. No. 29,379), 41870/1973 (corresponding to U.S. Pat. No. 3,930,863), etc.

As desired, two or more of the above described couplers and/or compounds may be incorporated into the same layer in order to meet the properties required for the desired light-sensitive material, and the same coupler or compound may be incorporated into two or more different layers.

The couplers and the like are added to the hydrophilic colloids of the photographic material by a conventional method. One method is described in, U.S. Pat. No. 2,322,027. In general, the couplers are dissolved in organic solvents having a boiling point of about 180° C. or more, such as alkyl esters of phthalic acid, e.g., methyl phthalate, ethyl phthalate, propyl phthalate, n-butyl phthalate, di-n-butyl phtalate, n-amyl phthalate, isoamyl phthalate, and dioctyl phthalate; alkylamides such as N,N-diethyl laurylamide; trimellitate esters such as tri-tert-octylmellitate; phosphates such as polyphenyl phosphate, tri-cresyl phosphate, dioctylbutyl phosphate; cutrates such as acetyltributyl citrate, or in organic solvents having a boiling point of about 30° C. to 150° C., such as lwer alkyl acetates such as ethyl acetate, butyl acetate, ethyl propionate, sec-butyl alcohol, methyl isobutyl ketone, $\beta$-ethoxyethyl acetate, methyl cellosolve acetate, and the like, and then are dispersed in conventional photographic hydrophilic colloid as earlier examplified. Mixtures of the above organic solvents can be used, if desired.

Where the coupler contains an acid group such as a carboxylic acid or sulfonic acid group, it is generally added to a hydrophilic colloid as an alkaline aqueous solution thereof.

The couplers are generally added in an amount of about $2\times10^{-3}$ mole to about $5\times10^{-1}$ mole, preferably about $1\times10^{-2}$ mole to about $5\times10^{-1}$ mole, per mole of silver in the emulsion layer (total coupler(s) in any one emulsion layer).

While not particularly limitative- for many commercial products the amount of silver in the optical picture image recording layers is from about 0.2 to about 2 g/m$^2$ in one emulsion layer and the amounts of silver in the ultraviolesensitive sound image recording layers is about 0.2 to about 5 g/m$^2$.

The thickness of both the picture image-forming silver halide emulsion layer and the sound image-forming silver halide emulsion layer generally range from about 1 to about 6$\mu$ for commercial products, though one skilled in the art will appreciate this is not limitative. Similarly, gelatin intermediate layers and gelatin protective layers usually range from about 0.5 to about 2$\mu$, and when the gelatin intermediate layer contains ultraviolet ray absorbing agents, the layer is generally about 1 to 6$\mu$ in thickness.

The photographic supports on which coating solution in accordance with the present invention are coated to provide hydrophilic colloid photographic layers of the present invention are conventional and include a cellulose nitrate film, a cellulose acetate film, a cellulose acetate butyrate film, a cellulose acetate propionate film, a polystyrene film, a polyethylene terephthalate film, a polycarbonate film, or laminates thereof, etc., as are generally used in photographic light-sensitive materials. Where adhesion between the support and the photographic emulsion layer is insufficient, a conventional layer having adhesion to both may be provided as subbing layer and/or an undercoating layer. Moreover, in order to further improve adhesion, generally used preliminary treatments such as a corona discharge, ultraviolet ray irradiation, flame treatment, etc., may be applied to the surface of the support.

To obtain color images in color photographic light-sensitive materials of the present invention, it is merely necessary that the light-sensitive materials be exposed to light and then processed by a conventional color image development process. The primary processing steps include, fundamentally, color development, bleaching and fixing. In this case, each step may be carried out individually, or two or more steps may be carried out at one time by using processing solutions having multiple capabilities, e.g., a blix bath may be taken as an example. Furthermore, each step may be carried out two or more times separately, or a combined color development, first fixing and a blixing is possible. As desired, the developing processing may further include various conventional steps such as preliminary hardening, a neutralizing, a first development (black and white development), an image stabilizing, washing, etc.

Processing temperatures are adjusted to the desired ranges according to the light-sensitive materials and processings. The temperature is sometimes 18° C. or less, but is usually 18° C. or more. In particular, temperatures of 20° C. to 60° C., and recently, 30° C. to 60° C., are often used. It is unnecessary that all processing steps be at the same temperature.

Color developers are those compounds whose oxidation products react with color couplers, thereby producing a colored dye product, that is, an aqueous alkali solution containing one or more developing agents and having a pH of about 8 or more, preferably 9 to 12.

Developing agents as described above are conventional and include those compounds containing primary amino groups at their aromatic nuclei which are capable of developing exposed silver halide, or precursors capable of producing such compounds. Typical examples of such developing agents are 4-amino-N, N-diethyl aniline, 3-methyl-4-amino-N,N-diethyl aniline, 4-amino-N-ethyl-N-β-hydroxyethyl aniline, 3-methyl-4-amino-N-ethyl-N-β-hydroxyethyl aniline, 4-amino-3-methyl-N-ethyl-N-β-methanesulfoamidoethyl aniline, 4-amino-N,N-dimethyl aniline, 4-amino-3-methoxy-N,N-diethyl aniline, 4-amino-3-methyl-N-ethyl-N-β-methoxyethyl aniline, 4-amino-3-methoxy-N-ethyl-N-β-methoxyethyl aniline, 4-amino-3-β-methanesulfoamidoethyl-N,N-diethyl aniline, and salts thereof, e.g., sulfates, hydrochlorides, sulfites, p-toluensulfonates, etc. Other examples are described in U.S. Pat. Nos. 2,193,015, 2,592,364, Japanese Pat. (OPI) No. 64933/1973, and L. F. A. Mason, *Photographic Processing Chemistry,* Focal Press, London (1966), pages 226 to 229, etc. Moreover, the above described compounds can be used in combination with 3-pyrazolidones. Various additives can be added to the color developer, if desired.

Such additives are conventional and include alkali agents such as alkali metal hydroxides, carbonates, and phosphates and ammonium salts thereof; pH controlling agents or buffers such as weak acids, e.g., acetic acid and boric acid, and weak bases, and salts thereof; development accelerating agents such as pyridinium compounds and cationic compounds as described in U.S. Pat. Nos. 2,648,604, 3,671,247, etc., potassium nitrate and sodium nitrate, polyethylene glycol condensates and derivatives thereof as described in U.S. Pat. Nos. 2,533,990, 2,577,127, 2,950,970, etc., nonionic compounds such as polythioethers and the like, typical examples of which are described in British Pat. Nos. 1,020,033, and 1,020,032, polymer compounds containing a sulfite ester group therein, typical examples of which are described in U.S. Pat. No. 3,068,097, and in addition, organic amines such as pyridine, ethanolamine, and the like, benzyl alcohol, hydrazines, etc.; anti-fogging agents such as alkali bromides, alkali iodides, and nitrobenzoimidazoles as described in U.S. Pat. Nos. 2,496,940, 2,656,271, mercaptobenzoimidazole, 5-methylbenzotriazole, 1-phenyl-5-mercaptotetrazole, compounds for rapid processing solutions as described in U.S. Pat. Nos. 3,113,864, 3,342,596, 3,295,976, 3,615,522, 3,597,199, etc., thiosulfonyl compounds as described in British Pat. No. 972,211, phenazine-N-oxides as described in Japanese Pat. No. 41675/1971, and fog-controlling agents as described in *Kagaku Shashin Binran,* Volume II, pages 29 to 47, etc,; and in addition, stain or sludge-preventing agents as described in U.S. Pat. Nos. 3,161,513, 3,161,514, British Pat. Nos. 1,030,442, 1,144,481, 1,251,558 etc; multi-layer effect accelerating agents as described in U.S. Pat. No. 3,536,487; preservatives such as sulfites, bisulfites, hydroxylamine hydroxylamine hydrochloride, formaldehyde-sulfite adducts, alkanolamine sulfite adducts, etc.

As bleaching solutions, conventional bleaching solutions containing known bleaching agents such as ferricyanides, bichromates, iron (III) salts, and the like can be used. All silver oxidizing agents which are usable for photographic bleaching solutions can be used in the bleaching bath of the present invention. For example, water-soluble ferricyanides, e.g., sodium ferricyanide, potassium ferricyanide, ammonium ferricyanide, etc., water-soluble quinones, e.g., quinone, chloroquinone, methylquinone, and the like, water-soluble ferric salts, e.g., ferric chloride, ferric sulfate, ferric thiocyanate, ferric oxalate, and the like, water-soluble cupric salts, e.g., cupric chloride, cupric nitrate, and the like, water-soluble cobalt (III) salts, e.g., cobalt chloride, ammonium cobalt (III) nitrate, and the like, can be used. In addition, polyvalent cations of water-soluble organic acids and alkali metal complex salts are advantageously used.

Representative examples of such organic acids are malonic acid, tartaric acid, ethylmalonic acid, malic acid, fumaric acid, diglycolic acid, thioglycol acid, ethyliminodipropionic acid, nitrilotriacetic acid, ethylenediamine tetraacetic acid, aminotriacetic acid, ethylenedithioglycolic acid, dithioglycolic acid, and the like.

Examples of polyvalent cations as mentioned above are ferric ions, cobalt (III) ions, and cupric ions. An iron-sodium complex salt of ethylenediamine tetraacetic acid is particularly useful as a bleaching agent.

Suitable examples of such bleaching agents are described in *Journal of the Society of Motion Picture and Television Engineers,* Vol. 61, pages 667 to 701 (1953), U.S. Pat. No. 3,189,452, German Pat. Nos. 866,605, 966,410, U.S. Pat. No. 3,582,322, and *British Journal of Photography,* Vol. 107, pages 122 to 123, and page 126 (1966).

Fixing solutions are used to remove soluble silver salts from photographic materials. As fixing agents, any of those compounds generally used as solvents for silver halides in the photographic arts can be used. For example, fixing solutions containing water-soluble thiosulfates (e.g., sodium thiosulfate, potassium thiosulfate, ammonium thiosulfate, and the like), water-soluble thiocyanides (e.g., sodium thiocyanide, potassium thiocyanide, ammonium thiocyanide, and the like), water-soluble oxygen-or sulfur-containing organic diols (e.g., 3-thia-1,5-pentandiol, 3,6-dithia-1,8-octandiol, 9-hexa-3,6,12,15-tetrathia-1,17-heptadecandiol, and the like); water-soluble sulfur-containing dibasic acids; and water-soluble salts thereof (e.g., ethylene bisthioglycolic acid and the sodium salt thereof, and the like), imidazolidinethion (methylimidazolidinethion and the like), etc., can be advantageously used.

In addition, those fixing agents described in L. F. A. Mason, *Photographic Processing Chemistry,* pages 187 to 188, Focal Press (1966) can be advantageously used.

The bleaching step and the fixing step can be, if desired, carried out in one bath (blixing). Conventional combinations of bleaching agents and fixing agents as described above can be used. Examples of such blixing baths are described in German Pat. No. 866,605, U.S. Pat. No. 3,582,322, etc.

It is advantageous that each processing solution be regenerated, recycled, and reused. Such a procedure is described in, for example, *Journal of the Society of Motion Picture and Television Engineers,* Vol. 81, pages 293 to 295 (1972).

Silver is advantageously recovered from the fixing solution. The method of recovering silver is described in, for example, *Journal of the Society of Motion Picture and Television Engineers,* Vol. 81, pages 603 to 608.

The present invention will be illustrated in more detail by reference to the following non-limiting examples.

EXAMPLE 1

On one side of a cellulose triacetate film support was coated an anti-halation layer containing carbon black. On the other side thereof, there was coated a subbing layer. On the subbing layer were then provided the following layers in the recited order to produce a silver halide-multi-layer color photographic light-sensitive material.

| | | |
|---|---|---|
| First Layer | Blue-sensitive layer | (AgBrI(I: 2 mol%)) |
| Second Layer | Intermediate layer | (1) |
| Third Layer | Red-sensitive layer | (AgBrCl (Br: 30 mol%)) |
| Fourth Layer | Intermediate layer | (2) |
| Fifth Layer | Green-sensitive layer | (AgBrCl (Br. 30 mol%)) |
| Sixth Layer | Protective layer | |

Couplers used in the blue-sensitive, red-sensitive, and green sensitive layers had the following structures. These couplers were dissolved in a conventional manner in a mixed solvent of dibutyl phthalate and ethyl acetate, dispersed in gelatin, and then added to the corresponding emulsion layers.

Yellow dye-forming coupler

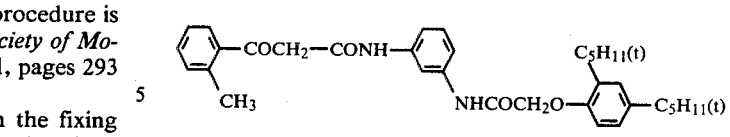

Cyan dye-forming coupler

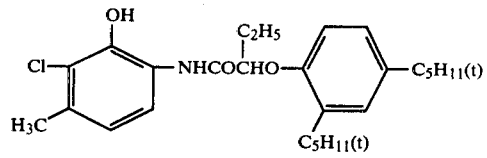

Magenta dye-forming coupler

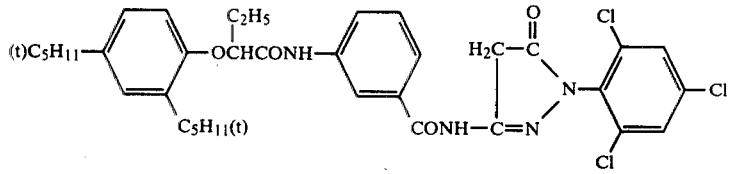

The structures of the spectral sensitizing dye used in the red-sensitive layer and in the green-sensitive layer, and the amounts thereof per mole of silver were as shown below.

Spectral sensitizing dye for the red-sensitive layer

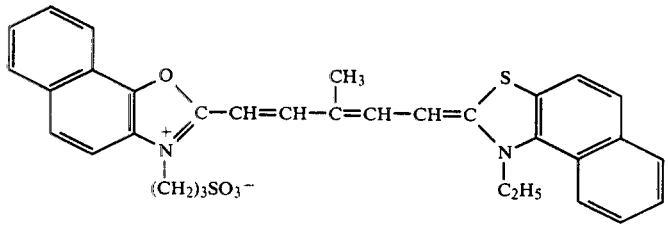

(amount 25 mg/Ag mole)

Spectral sensitizing dye for the green sensitive layer

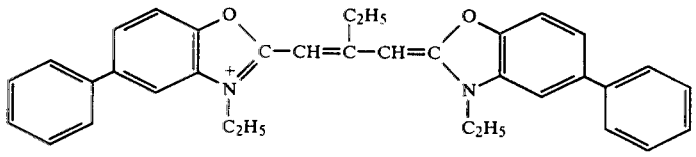

(amount 250 mg/Ag mole)

The coating amounts of silver, coupler, and gelatin in each layer were as shown in Table 1.

Table 1

| | Silver ($g/m^2$) | Coupler ($g/m^2$) | Gelatin ($g/m^2$) |
|---|---|---|---|
| First Layer (Blue-Sensitive) | 1.2 | 1.2 | 3.0 |
| Second Layer (Intermediate) | — | — | 0.8 |
| Third Layer (Red-Sensitive) | 0.6 | 1.0 | 1.8 |
| Fourth Layer (Intermediate) | — | — | 0.8 |
| FIfth Layer (Green-Sensitive) | 1.1 | 1.5 | 3.0 |
| Sixth Layer (Protective) | — | — | 0.7 |

As the protective layer (sixth layer), a coating solution of liquid paraffin dispersed in an aqueous solution of gelatin was coated.

The thus prepared Sample 1 was used as a control material. Between the fifth layer (green sensitive layer) and the sixth layer (protective layer) were provided a gelatin intermediate layer (coating amount of gelatin: 0.8 g/m$^2$) and an ultraviolet ray sensitive silver halide emulsion layer containing silver bleach inhibitors A and B (sound track-forming layer; coated amount of silver, 1.5 g/m$^2$; silver chloride bromide emulsion containing 10 mole % of bromide) to prepare Sample 2. In addition, Sample 3, 4, 5 and 6 were prepared respectively by adding infrared coupler II-6, III-3, III-5 and IV-3 to the ultraviolet ray-sensitive silver halide emulsion layer containing silver bleach inhibitors A and B. Ultraviolet ray absorbing agents A and B were incorporated into the fifth layer (green sensitive layer) of Sample 3, 4, 5 and 6 to prepare Sample 7, 8, 9, and 10.

The structures of the silver bleach inhibitors used in the ultraviolet ray sensitive silver halide emulsion layer of Sample 2 and the ultraviolet ray absorbing agent used in the green sensitive silver halide emulsion layer of Sample 7 to Sample 10 are shown below. The structure of infrared coupler used in the ultraviolet ray sensitive silver halide emulsion layer of Sample 3 to Sample 10 are described above.

Silver bleach inhibitor (A)

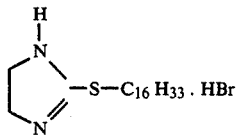

(B)

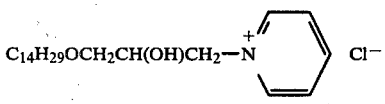

Ultraviolet ray absorbing agent (A)

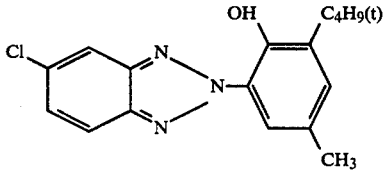

(B)

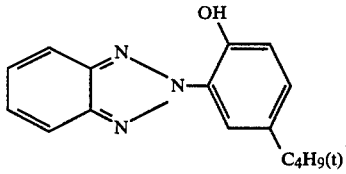

The coating amounts of the above silver bleach inhibitors A and B infrared couplers II-6, III-3, III-5 and IV-3, and the ultraviolet ray absorbing agents A and B are shown in Table 2.

Table 2

| | | Quantity (g/m$^2$) |
|---|---|---|
| Silver bleach Inhibitor | A | 0.12 |
| | B | 0.24 |
| Infrared Coupler | II-6 | 0.6 |
| | III-3 | 0.6 |
| | III-5 | 0.6 |
| | IV-3 | 0.6 |

Table 2-continued

| | | Quantity (g/m$^2$) |
|---|---|---|
| Ultraviolet ray absorbing | A | 0.25 |
| Agent | B | 0.25 |

Samples (1) to (10) were then step-wise exposed (corresponding to sound image-forming exposure; 100,000 lux for 1/100 sec.) with tungusten light having a color temperature or 2854° K. as a light source through a silver wedge and a visible light-absorbing filter (Toshiba Glass Filter UV-D-25); hereafter, this exposure is referred to as Exposure 1.

On the other hand, separately, step-wise exposure through a silver wedge and an ultraviolet ray absorbing filter (Fuji Filter Sc-41) corresponding to picture image-forming exposure; 100,000 lux for 1/100 sec.) was applied to Samples (1) to (10) (hereafter, this exposure is referred to as Exposure 2).

The thus exposed samples were processed according to the following Processings I and II. The density of each of the films obtained in the infrared region was measured with a Macbeth TD-206A photo densitometer using a Stitus S-58 Filter. The results obtained are shown in Table 3.

| Processing 1 | Temp. (°C.) | Time |
|---|---|---|
| Pre-hardening Bath | 27 | 10 sec. |
| Water Wash | " | 15 sec. |
| Color Development | " | 5 min, 20 sec. |
| Water Wash | " | 15 sec. |
| First Fix | " | 1 min. |
| Water Wash | " | 40 sec. |
| Bleach | " | 3 min. |
| Water Wash | " | 1 min. |
| Sound Development | room temperature | 15 sec. |
| Water Wash | 27 | 15 sec. |
| Second Fix | " | 2 min. |
| Water Wash | " | 5 min. |
| Stabilization | " | 10 sec. |

The composition of each processing bath was as follows:

| | |
|---|---|
| Pre-hardening Bath | |
| Water | 800 ml |
| Sodium Carbonate (monohydrate) | 10.0 g |
| Sodium Sulfate (anhydrous) | 50.0 g |
| Water to make | 1.0 liter |
| Color Developer | |
| Water | 800 ml |
| Sodium Hexamethaphosphate | 2.0 g |
| Sodium Sulfite (anhydrous) | 4.0 g |
| 2-Amino-5-diethylaminotoluene Hydrochloride | 3.0 g |
| Sodium Carbonate (monohydrate) | 25.0 g |
| Potassium Bromide | 2.0 g |
| Water to make | 1.0 liter |
| First and Second Fixing Solutions | |
| Water | 600 ml |
| Sodium Thiosulfate (pentahydrate) | 240 g |
| Sodium Sulfite (anhydrous) | 15.0 g |
| Glacial Acetic Acid | 12.0 g |
| Boric Acid | 6.0 g |
| Potassium Alum | 15.0 g |
| Water to make | 1.0 liter |
| Bleaching Solution | |
| Water | 800 ml |
| Potassium Bromide | 20.0 g |
| Potassium Bichlorate | 5.0 g |
| Potassium Alum | 40.0 g |
| Sodium Acetate (trihydrate) | 3.0 g |

-continued

| | |
|---|---|
| Glacial Acetic Acid | 10.0 g |
| Water to make | 1.0 liter |
| Sound Developer | |
| (A Solution) | |
| Water | 600 ml |
| Anhydrous Sodium Sulfite | 40.0 g |
| N-Methyl-p-aminophenol Sulfate | 40.0 g |
| Sodium Hydroxide | 40.0 g |
| Hydroquinone | 40.0 g |
| (B Solution) | |
| Water | 300 ml |
| Tragacanth Gum | 5.0 g |
| Denatured Alcohol | 10 ml |
| (C Solution) | |
| Ethylenediamine (70%) | 20 ml |

Solutions A and B were mixed, and Solution C and water added just before the use to make 1.0 liter.

| Stabilizing Bath | |
|---|---|
| Water | 800 ml |
| Formalin (37%) | 10 ml |
| 40% Solution of Polyethylene Glycol in Water | 5 ml |
| Water to make | 1.0 liter |

| Processing II | Temp. (°C.) | Time |
|---|---|---|
| Pre-hardening Bath | 27 | 10 sec. |
| Water Wash | " | 15 sec. |
| Color Development | " | 5 min. 20 sec. |
| Water Wash | " | 15 sec. |
| First Fix | " | 1 min. |
| Water Wash | " | 40 sec. |
| Bleach | " | 3 min. |
| Water Wash | " | 1 min. |
| Second Fix | " | 2 min. |
| Water Wash | " | 5 min. |
| Stabilizing | " | 10 sec. |

Each processing solution was the same as described in Processing A.

Table 3

| Sample | Sound track forming layer | Infrared coupler | UV absorbing agent | Exposure | Processing | Infrared density |
|---|---|---|---|---|---|---|
| | | | | 1 | I | 1.2 |
| 1 | – | – | – | | II | 0.2 |
| | | | | | I | 1.7 |
| | | | | 2 | II | 0.2 |
| 2 | + | – | – | 1 | II | 1.4 |
| 3 | + | II-6 | – | 1 | II | 1.8 |
| 4 | + | III-3 | – | 1 | II | 2.0 |
| 5 | + | III-5 | – | 1 | II | 1.8 |
| 6 | + | IV-3 | – | 1 | II | 1.8 |
| 7 | + | II-6 | + | 1 | II | 1.9 |
| 8 | + | III-3 | + | 1 | II | 2.0 |
| 9 | + | III-5 | + | 1 | II | 1.8 |
| 10 | + | IV-3 | + | 1 | II | 1.8 |

Note: The symbols "+" and "–" indicate "present" and "absent", respectively.

From the results shown in Table 3, it can be seen that a conventional light-sensitive material, Sample 1 (containing neither silver bleach inhibitor nor infrared dye-forming coupler) did not exhibit sufficient infrared density unless sound development was conducted, whereas light-sensitive materials containing either a silver bleach inhibitor or an infrared dye-forming coupler, Sample 3 to Sample 10, showed sufficient infrared density without sound development compared with Sample 2 containing a silver bleach inhibitor only, though the coating amount of silver in the sound track-forming layer of Sample 3 to Sample 10 was less than that of Sample 2.

With Sample 7 to Sample 10, superposition of color images on silver sound image area where the sound image-forming exposure and Processing II were applied was extremely low as compared to Samples 2 to Sample 6. Furthermore, with Sample 2 to Sample 10, superposition of silver images on color image area where the picture dye-image-forming exposure using an UV absorbing filter and the Picture II were applied was low and picture dye image of Sample 2 to Sample 10 had a high color saturation as compared with that without using said UV absorbing filter.

While the invention has been described in detail and with reference to specific embodiments thereof, it will be apparent to one skilled in the art that various changes and modifications can be made therein without departing from the spirit and scope thereof.

What is claimed is:

1. A process for producing an optical sound track comprising image-wise exposing the optical sound track area of a multi-layer color photographic light-sensitive material to ultraviolet rays and color photographically processing the light-senstive material, the light-sensitive material comprising (1) a support, (2) a group of color picture image-forming layers comprising (a) at least one blue-senstive silver halide emulsion layer containing at least one yellow dye-forming coupler, (b) at least one red-senstive silver halide emulsion layer containing at least one cyan dye-forming coupler, and (c) at least one green-sensitive silver halide emulsion layer containing at least one magenta dye-forming coupler, and (3) at least one ultraviolet ray-sensitive silver halide emulsion layer as the sound track area which contains a non-diffusible silver bleach inhibitor and an infrared dye-forming coupler, said at least one ultraviolet ray-sensitive silver halide emulsion layer being positioned on said group of color image-forming layers (a), (b) and (c) or intermediate two of said color picture image-forming layers (a), (b) and (c), and wherein the light-sensitive material contains at least one non-diffusible ultraviolet ray absorbing agent positioned between said support (1) and said ultraviolet ray-sensitive silver halide emulsion layer (3) and in at least one of said picture image-forming layers (a), (b) and (c) or in a layer on at least one of said picture image-forming layers (a), (b) and (c); wherein the infrared dye-forming coupler is a coupler selected from the group consisting of couplers represented by the following formulae II, III and IV:

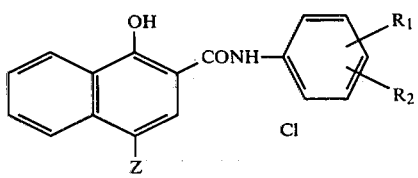

(II)

-continued (III)

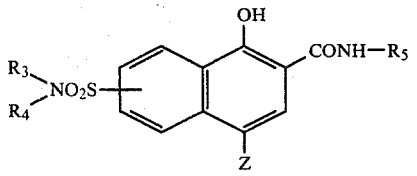

(IV)

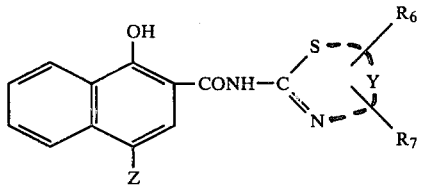

wherein Z represents a hydrogen atom or a coupling-off group; Y represents nonmetallic atoms necessary to complete a thiazole or benzothiazole nucleus; $R_1$ represents a hydrogen atom or a more electron attractive group than a hydrogen atom $R_3$ and $R_4$ each represent a hydrogen atom or an alkyl group having 1 to 20 carbon atoms, each may be same or different, $R_5$ represents an alkyl group or an alkenyl group having 12 or more carbon atoms, or a

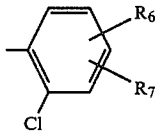

group;

$R_6$ represents a hydrogen atom or a lower alkyl group having 1 to 4 carbon atoms; and $R_2$ and $R_7$ each represent a ballast group having 6 or more carbon atoms, each may be bonded to the phenyl nuclei either directly or via an amino bond, an ether bond, a thioether bond, a carbonamide bond, a sulphonamide bond urea bond, an ester bond, an imide bond, a carbonyl bond or a sulphonyl bond.

2. The process of claim 1 wherein said coupling-off group is a member selected from the group consisting of a halogen atom, a thiocyano group, an acyloxy group, an alkoxy group, an aryloxy group, an alkyl thio group, an aryl thio group, and a dyclic imido group.

3. The process of claim 2 wherein said electron attractive group is a halogen atom.

4. A process for producing sound images on an optical sound track area of a multi-layer color photographic light-sensitive material comprising an optical sound track area and a picture image area, which process comprises image-wise exposing the optical sound track area of the light-sensitive material to ultraviolet light and image-wise exposing the picture image area thereof to visible light and then color photographically processing the light-senitive material without a separate sound development step, the light-sensitive material comprising (1) a support, (2) a group of color picture image-forming layers comprising (a) at least one blue-sensitive silver halide emulsion layer containing at least one yellow dye-forming coupler, (b) at least one red-sensitive silver halide emulsion layer containing at least one cyan dye-forming coupler, (c) at least one green-sensitive silver halide emulsion layer containing at least one magenta dye-forming coupler, and (3) at least one ultraviolet ray-sensitive silver halide emulsion layer containing at least one non-diffusible silver bleach inhibitor and an infrared dye-forming coupler which forms a dye having an absorption maximum at wavelengths longer than 725 nm, said at least one ultraviolet ray-sensitive silver halide emulsion layer being positioned on said group of color picture image-forming layers (a), (b), and (c) or intermediate two of said color picture image-forming layers (a), (b) and (c), and wherein the light-sensitive material contains at least one non-diffusible ultraviolet ray absorbing agent positioned between said support (1) and said ultraviolet ray-sensitive silver halide emulsion layer (3) and in at least one of said picture image-forming layers (a), (b) and (c) or in a layer on at least one of said picture image-forming layers (a), (b) and (c); wherein the infrared dye-forming coupler is a coupler selected from the group consisting of couplers represented by the following formulae II, III and IV:

(II)

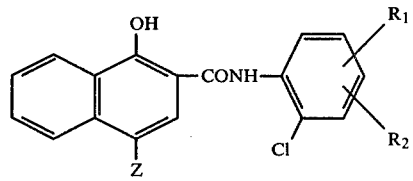

(III)

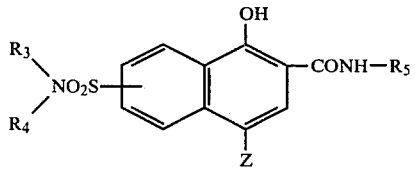

(IV)

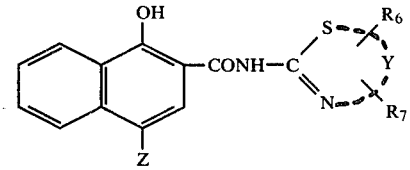

wherein Z represents a hydrogen atom or a coupling-off group; Y represents nonmetallic atoms necessary to complete a thiazole or benzothiazole nucleus; $R_1$ represents a hydrogen atom or a more electron attractive group than a hydrogen atom $R_3$ and $R_4$ each represent a hydrogen atom or an alkyl group having 1 to 20 carbon atoms, each may be same or different, $R_5$ represents an alkyl group or an alkenyl group having 12 or more carbon atoms, or a

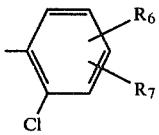

group;

$R_6$ represents a hydrogen atom or a lower alkyl group having 1 to 4 carbon atoms; and $R_2$ and $R_7$ each represent a ballast group having 6 or more carbon atoms, each may be bonded to the phenyl nuclei either directly or via an amino bond, an ether bond, a thioether bond, a carbonamide bond, a sulphonamide bond urea bond, an ester bond, an imide bond, a carbonyl bond or a sulphonyl bond.

5. The process of claim 4 wherein said coupling-off group is a member selected from the group consisting of a halogen atom, a thiocyano group, an acryloxy group, an alkoxy group, an acyloxy group, an alkyl thio group, an aryl thio group, and a cyclic imido group.

6. The process of claim 5 wherein said electron attractive group is a halogen atom.

7. The process according to claim 4, wherein the wave length of the ultraviolet ray used to expose the sound track area is shorter than about 400 nm and shorter than the wavelength of the visible light.

8. The process according to claim 4, wherein the wave length of the visible rays applied to the picture image area is longer than about 400 nm and longer than the wavelength of the ultraviolet rays.

9. The process according to claim 4, wherein the ultraviolet ray-absorbing material is in the green-sensitive silver halide emulsion layer.

10. The process according to claim 4, wherein the ultraviolet ray-absorbing agent is in an intermediate layer in contact with the green-sensitive silver halide emulsion layer.

11. The process according to claim 4, wherein the ultraviolet ray-absorbing agent is in the red-sensitive silver halide emulsion layer.

12. The process according to claim 4, wherein the ultraviolet ray-absorbing agent is in an intermediate layer in contact with the red-sensitive silver halide emulsion layer.

13. The process according to claim 4, wherein the ultraviolet ray-absorbing agent is in the blue-sensitive silver halide emulsion layer.

14. The process according to claim 4, wherein the light-sensitive silver halide emulsion layer of the sound track-forming layer comprises a silver chlorobromide emulsion containing not more than 60 mole % bromide.

15. The process according to claim 4, wherein the ultraviolet ray-absorbing agent is a benzotriazole.

16. The process according to claim 15, wherein the benzotriazole is a benzotriazole having an aryl group at the nitrogen atom of the 2-position thereof.

17. The process according to claim 16, wherein the benzotraizole is a compound represented by the formula 1:

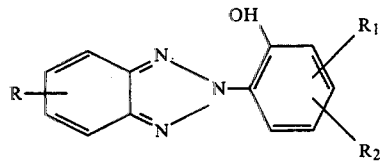

(I)

wherein R, $R_1$, and $R_2$ are a hydrogen atom a halogen atom, a nitro group, an alkyl group, an alkoxy group, an aryl group or an aryloxy group.

* * * * *